US009696007B2

(12) United States Patent
Min et al.

(10) Patent No.: US 9,696,007 B2
(45) Date of Patent: Jul. 4, 2017

(54) LIGHTING DEVICE WITH SELECTIVELY CONTROLLED CONCENTRIC LIGHT EMITTING MODULES

(71) Applicant: LG INNOTEK CO., LTD., Seoul (KR)

(72) Inventors: Byeong Guk Min, Seoul (KR); Kyung Il Kong, Seoul (KR)

(73) Assignee: LG INNOTEK CO., LTD, Seoul (KR)

( * ) Notice: Subject to any disclaimer, the term of this patent is extended or adjusted under 35 U.S.C. 154(b) by 154 days.

(21) Appl. No.: 14/592,019

(22) Filed: Jan. 8, 2015

(65) Prior Publication Data

US 2015/0124446 A1 May 7, 2015

Related U.S. Application Data

(62) Division of application No. 13/541,247, filed on Jul. 3, 2012, now Pat. No. 9,234,645.

(30) Foreign Application Priority Data

Jul. 6, 2011 (KR) ..... 10-2011-0066714
Jul. 8, 2011 (KR) ..... 10-2011-0067698

(51) Int. Cl.
*F21V 7/00* (2006.01)
*F21V 7/18* (2006.01)
(Continued)

(52) U.S. Cl.
CPC ..... *F21V 7/00* (2013.01); *F21K 9/233* (2016.08); *F21V 7/0025* (2013.01); *F21V 7/16* (2013.01);
(Continued)

(58) Field of Classification Search
CPC ..... F21V 7/0083; F21V 7/043; F21V 14/06; F21V 14/065; F21Y 2105/18;
(Continued)

(56) References Cited

U.S. PATENT DOCUMENTS 172,137 A * 1/1876 Martine ..... F21V 17/00 362/433
965,544 A * 7/1910 Smith ..... G09F 13/06 220/288
(Continued)

FOREIGN PATENT DOCUMENTS

CN 201858531 U 6/2011
DE 549 332 C 4/1932
(Continued)

OTHER PUBLICATIONS

International Search Report dated Jan. 29, 2013 issued in Application No. PCT/KR2012/005265.
(Continued)

*Primary Examiner* — Ismael Negron
(74) *Attorney, Agent, or Firm* — KED & Associates, LLP

(57) ABSTRACT

A lighting device includes a driving unit, a body arranged under the driving unit, a first light emitting module powered by the driving unit and disposed in a first area of the body, a second light emitting module powered by the driving unit and disposed in a second area of the body surrounding the first area, a first reflector surrounding the first light emitting module, and a second reflector surrounding the second light emitting module, and the first reflector. The driving unit controls the first light emitting module and the second light emitting module independently of each other.

6 Claims, 8 Drawing Sheets

(51) Int. Cl.

| | |
|---|---|
| ***F21V 13/02*** | (2006.01) |
| ***F21V 23/04*** | (2006.01) |
| ***F21V 7/16*** | (2006.01) |
| ***F21V 14/06*** | (2006.01) |
| ***F21V 14/04*** | (2006.01) |
| ***F21V 23/00*** | (2015.01) |
| ***F21K 9/233*** | (2016.01) |
| *F21V 7/22* | (2006.01) |
| *F21V 7/04* | (2006.01) |
| *F21V 29/76* | (2015.01) |
| *F21V 29/89* | (2015.01) |
| *F21Y 105/10* | (2016.01) |
| *F21Y 115/10* | (2016.01) |

(52) U.S. Cl.

CPC ..... *F21V 7/18* (2013.01); *F21V 13/02* (2013.01); *F21V 14/04* (2013.01); *F21V 14/06* (2013.01); *F21V 23/008* (2013.01); *F21V 23/04* (2013.01); *F21V 7/043* (2013.01); *F21V 7/22* (2013.01); *F21V 29/763* (2015.01); *F21V 29/89* (2015.01); *F21Y 2105/10* (2016.08); *F21Y 2115/10* (2016.08)

(58) Field of Classification Search

CPC ..... F21Y 2105/14; F21Y 2105/10; F21Y 2105/00; F21L 15/02

USPC ..... 362/514, 187, 188, 249.07, 277, 278, 362/281, 297, 304, 350, 294, 455, 456

See application file for complete search history.

(56) References Cited

U.S. PATENT DOCUMENTS

| | | | | |
|---|---|---|---|---|
| 1,082,887 | A | 12/1913 | Maisel | 362/204 |
| 1,083,362 | A * | 1/1914 | Grahmann | F21V 5/00 362/340 |
| RE15,022 | E | 1/1921 | Burgess | 362/187 |
| 1,392,165 | A | 9/1921 | Hunter | 362/187 |
| 1,478,282 | A | 12/1923 | Hunter | 362/187 |
| 1,583,677 | A * | 5/1926 | Edelmann | F21S 48/1208 24/279 |
| 1,609,901 | A | 12/1926 | Boeckenhauer | 362/187 |
| 1,621,955 | A | 3/1927 | Schiffner | 362/187 |
| 1,769,781 | A | 7/1930 | Laurence | 362/278 |
| 1,778,039 | A | 10/1930 | Rogge | 362/187 |
| 2,309,104 | A | 1/1943 | Dircksen | 362/277 |
| 3,839,632 | A | 10/1974 | Federico | 362/44.1 |
| 4,855,884 | A | 8/1989 | Richardson | 362/278 |
| 5,198,832 | A | 3/1993 | Higgins et al. | 343/915 |
| 5,451,975 | A | 9/1995 | Miller et al. | 343/915 |
| 5,630,661 | A | 5/1997 | Fox | 362/187 |
| 5,752,766 | A | 5/1998 | Bailey et al. | 362/250 |
| 5,791,768 | A | 8/1998 | Splane, Jr. | 362/280 |
| 6,068,388 | A | 5/2000 | Walker et al. | 362/304 |
| 6,183,100 | B1 * | 2/2001 | Suckow | B60Q 1/2611 257/E25.028 |
| 6,830,362 | B2 * | 12/2004 | Mullen | F21V 17/164 362/455 |
| 6,866,401 | B2 * | 3/2005 | Sommers | F21V 5/006 362/169 |
| 7,207,697 | B2 * | 4/2007 | Shoji | F21V 5/045 362/187 |
| 7,452,111 | B2 | 11/2008 | Mazzei | 362/346 |
| 7,461,945 | B2 * | 12/2008 | Shiau | F21V 14/065 362/174 |
| 7,665,866 | B2 * | 2/2010 | Mayer | F21V 7/04 362/241 |
| 7,771,086 | B2 | 8/2010 | Goverde | 362/294 |
| 8,240,880 | B2 * | 8/2012 | Chen | F21S 8/06 362/235 |
| 9,016,896 | B1 * | 4/2015 | Roudeski | F21V 7/04 340/953 |
| 2006/0274526 | A1 * | 12/2006 | Weston | G09F 13/04 362/249.16 |
| 2012/0081901 | A1 | 4/2012 | Tsang | 362/277 |

FOREIGN PATENT DOCUMENTS

| | | | |
|---|---|---|---|
| JP | 52 142780 | U | 10/1977 |
| JP | 60-30246 | U | 2/1987 |
| JP | 62 30246 | U | 2/1987 |
| JP | 3-129294 | U | 12/1991 |
| JP | 3139290 | U | 1/2008 |
| KR | 10-2009-0017941 | A | 2/2009 |
| KR | 10-2011-0050911 | A | 5/2011 |
| KR | 10-2011-0066249 | A | 6/2011 |

OTHER PUBLICATIONS

European Search Report dated Oct. 20, 2014 issued in Application No. 12807295.6.

United States Notice of Allowance dated Oct. 8, 2014 issued in U.S. Appl. No. 13/541,247.

United States Final Office Action dated Jun. 5, 2015 issued in U.S. Appl. No. 13/541,247.

United States Office Action dated Feb. 6, 2015 issued in U.S. Appl. No. 13/541,247.

* cited by examiner

LIGHTING DEVICE WITH SELECTIVELY CONTROLLED CONCENTRIC LIGHT EMITTING MODULES

CROSS-REFERENCE TO RELATED APPLICATIONS

This application is a Divisional Application of U.S. application Ser. No. 13/541,247 filed Jul. 3, 2012, which claims priority from Korean Application No. 10-2011-0066714 filed Jul. 6, 2011 and No. 10-2011-0067698 filed Jul. 8, 2011 the disclosures of which are incorporated herein by reference.

BACKGROUND

1. Field

Embodiments may relate to a lighting device.

2. Background

A light emitting diode (LED) is an energy device for converting electric energy into light energy. Compared with an electric bulb, the LED has higher conversion efficiency, lower power consumption and a longer life span. As there advantages are widely known, more and more attentions are now paid to a lighting apparatus using the LED.

The lighting apparatus using the LED are generally classified into a direct lighting apparatus and an indirect lighting apparatus. The direct lighting apparatus emits light emitted from the LED without changing the path of the light. The indirect lighting apparatus emits light emitted from the LED by changing the path of the light through reflecting means and so on. Compared with the direct lighting apparatus, the indirect lighting apparatus mitigates to some degree the intensified light emitted from the LED and protects the eyes of users.

SUMMARY

One embodiment is a lighting device. The lighting device includes: a body; a light emitting module which is disposed on the body; an optical member which is disposed on the light emitting module and is installed to be movable up and down; and a reflector which is disposed between the body and the optical member and reflects light emitted from the light emitting module. A shape of the reflector is changed according to the moving of the optical member. A light distribution angle and a light distribution range of light passing through the optical member are variable depending on the change of the shape of the reflector.

Another embodiment is a lighting device. The lighting device includes: a body which has one side; a light emitting module which is disposed on the one side of the body; a cap which is disposed on the light emitting module and through which light emitted from the light emitting module passes; a reflector which is disposed between the one side of the body and the cap and surrounds the light emitting module; a cover which includes an opening in which the cap is disposed and is coupled to the body in such a manner as to be movable up and down on the one side of the body. An inclination of the reflector based on the one side of the body is changed by the moving of the cover.

Further another embodiment is a lighting device. The lighting device includes: a driving unit; a body which is disposed under the driving unit and includes one side including a first area and a second area surrounding the first area; a first light emitting module which receives electric power from the driving unit and is disposed in the first area of the body; a second light emitting module which receives electric power from the driving unit and is disposed in the second area of the body; a first reflector which is disposed on the one side of the body and surrounds the first light emitting module; and a second reflector which is disposed on the one side of the body and surrounds the second light emitting module. The driving unit controls the first light emitting module and the second light emitting module independently of each other.

BRIEF DESCRIPTION OF THE DRAWINGS

Arrangements and embodiments may be described in detail with reference to the following drawings in which like reference numerals refer to like elements and wherein.

DETAILED DESCRIPTION

A thickness or a size of each layer may be magnified, omitted or schematically shown for the purpose of convenience and clearness of description. The size of each component may not necessarily mean its actual size.

It should be understood that when an element is referred to as being 'on' or "under" another element, it may be directly on/under the element, and/or one or more intervening elements may also be present. When an element is referred to as being 'on' or 'under', 'under the element' as well as 'on the element' may be included based on the element.

An embodiment may be described in detail with reference to the accompanying drawings.

Figure 1:
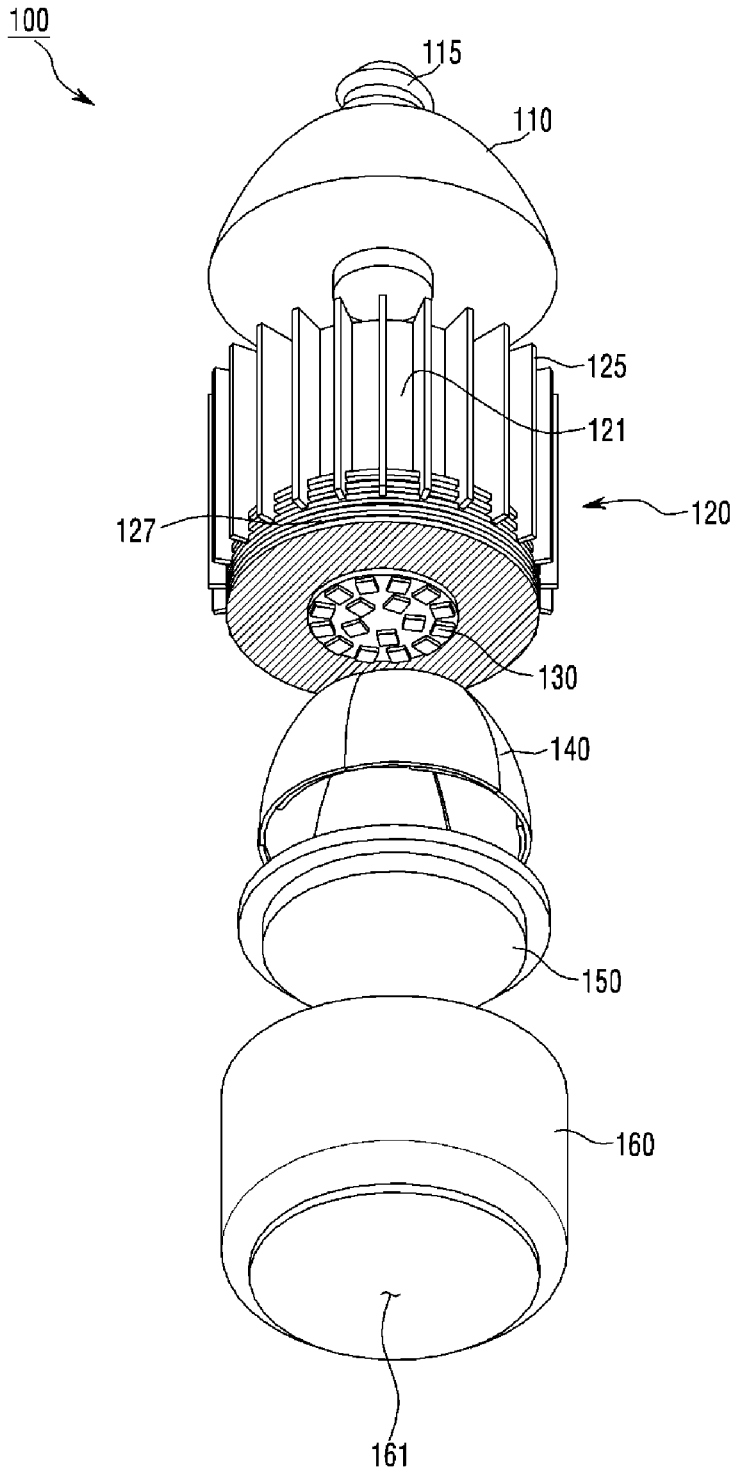
FIG. 1 is an exploded perspective view of a lighting device according to an embodiment.

FIG. 1 is an exploded perspective view of a lighting device according to an embodiment.

A lighting device 100 according to an embodiment may include a driving unit 110, a body 120, a light emitting module 130, a reflector 140 disposed on the outer circumference of the light emitting module 130, a cap 150 disposed under the reflector 140, and a cover 160 which surrounds an outer portion of the cap 150 and is coupled to the body 120.

Hereafter, the following detailed description will focus on the components of the lighting device 100 according to the embodiment. Also, a principle in which various optical characteristics are provided depending on the type of use of the lighting device 100 according to the embodiment will be described.

<Driving Unit 110>

The driving unit 110 is disposed on the body 120 and may be electrically connected to the light emitting module 130 through a wire passing through a through-hole formed at the central portion of the body 120. The driving unit 110 is connected to an external power supply and functions to supply electric power to the lighting device 100.

A plurality of parts for power control may be included in the driving unit 110. The plurality of the parts may include, for example, a DC converter converting AC power supply supplied by an external power supply into DC power supply, a driving chip controlling the driving of the light emitting module 130 and an electrostatic discharge (ESD) protective device for protecting the light emitting module 130.

The driving unit 110 is connected to the external power supply through a socket 115 of the upper portion thereof and may receive electric power from the external power supply. The wire from the driving unit 110 passes through the central portion of the body 120 and is connected to the light emitting module 130, so that electric power may be supplied to the light emitting module 130.

The bottom surface of the driving unit 110 may be disposed contacting with the top surface of the body 120. Heat generated from the driving unit 110 may be transferred to the body 120 functioning as a heat sink through the contact area.

<Body 120>

The body 120 may be disposed under the driving unit 110.

The body 120 is able to function as not only a housing for providing a space in which the light emitting module 130 is disposed but also a heat sink.

The body 120 is disposed between the driving unit 110 and the light emitting module 130 and is able to perform a function to receive and radiate heat generated from the driving unit 110 and the light emitting module 130.

Referring to FIG. 1, the body 120 may include a cylindrical heat radiating body 121 and heat radiating fins 125 formed on the outer circumferential surface of the heat radiating body 121. A plurality of the heat radiating fins 125 may be radially disposed along the surface of the heat radiating body 121.

A plurality of the heat radiating fins 125 increases the surface area of the body 120, thereby improving the heat radiation efficiency of the body 120. Since the contact area between the body 120 and the air is increased by increasing the number of the heat radiating fins 125, heat radiation efficiency is improved. However, a manufacturing cost rises and a structural vulnerability is caused. Meanwhile, since heating value is varied depending on the power capacity of the lighting device, it is necessary to appropriately determine the number of the heat radiating fins 125 in accordance with the power capacity.

The body 120 may be coupled close to the driving unit 110 and/or the light emitting module 130 such that heat generated from the driving unit 110 and/or the light emitting module 130 is directly conducted and radiated outwardly through the heat radiating fins 125. The heat radiating fin 125 functions to radiate outwardly the heat transferred from the driving unit 110 and/or the light emitting module 130. The heat radiating fin 125 may be integrally formed on the outer surface of the body 120 in an up-and-down longitudinal direction.

The body 120 may be formed of a metallic material or a resin material which has high heat radiation efficiency. The material of the body 120 is not limited. For example, the body 120 may be formed of Fe, Al, Ni, Cu, Ag, Sn and Mg or may be formed of an alloy including at least one of them. Carbon steel and stainless steel are also applied. An insulating coating process or an anti-corrosion coating process may be performed on the surface of the body 120 within a range which does not affect thermal conductivity.

Though not shown in the drawing, a heat radiating plate may be disposed between the driving unit 110 and/or the light emitting module 130 and the body 120. The heat radiating plate may be formed of a thermal conduction silicon pad or a thermal conductive tape which has a high thermal conductivity. The heat radiating plate is able to effectively transfer the heat generated from the driving unit 110 and/or the light emitting module 130 to the body 120.

A receiving recess in which the light emitting module 130 is disposed may be formed in the bottom surface of the body 120. However, the receiving recess may not be formed like the embodiment shown in FIG. 1. In this case, the light emitting module 130 may be arranged contacting with or close to the bottom surface of the body 120. The width and depth of the receiving recess is varied depending on the widths and thicknesses of the driving unit 110 and the light emitting module 130. The light emitting module 130 may be rotatably coupled to the body 120.

The reflector 140 which surrounds the light emitting module 130 and is disposed on the outer circumference of the light emitting module 130 is coupled to the bottom surface of the body 120 in such a manner as to be folded or unfolded. A method for connecting the body 120 with the reflector 140 will be described in detail in FIG. 3.

A coupling groove 127 may be disposed in the lower portion of the body 120. The coupling groove 127 may be coupled to a portion of the cover 160. The coupling groove 127 may be, as shown in FIG. 1, a screw groove. The cover 160 may be rotatably coupled to the body 120 through the screw groove.

<Light Emitting Module 130>

The light emitting module 130 may include at least one light emitting diode (LED), and a LED mounting substrate on which the at least one LED is mounted.

A plurality of the LEDs may be disposed on the LED mounting substrate. The number and arrangement of the LEDs to be disposed can be freely adjusted depending on a required illuminance. The light emitting module 130 may be formed in the form of a plurality of the collected LEDs such that it can be easily handled and advantageously produced.

The LED mounting substrate may be formed by printing a circuit pattern in an insulator. For example, the LED mounting substrate may include not only a printed circuit board (PCB), a metal core PCB, a flexible PCB and a ceramic PCB, but also a chips on board (COB) allowing an unpackaged LED chip to be directly bonded thereon. The LED mounting substrate may be formed of a material which efficiently reflects light. The surface of the LED mounting substrate may have a color capable of efficiently reflecting light, for example, white, silver and the like.

The LED mounted on the LED mounting substrate may be a red LED, green LED, blue LED or white LED, each of which emits red, green, blue or white light respectively. There is no limit to the kind and the number of the LEDs.

The light emitting module 130 may be disposed on the bottom surface of the body 120. The LED of the light emitting module 130 may be concentratively disposed in a portion of the bottom surface of the body 120 instead of being uniformly disposed.

The light emitting module 130 may be disposed apart from the central axis of the bottom surface of the body 120. Contrarily, the LEDs of the light emitting module 130 may be radially disposed on the basis of the central axis of the bottom surface of the body 120.

The reflector 140 may be disposed on the outer circumference of the light emitting module 130. The reflector 140 disposed to surround the light emitting module 130 reflects the light generated from the light emitting module 130, and is able to adjust the distribution angle and distribution range of light emitted from the lighting device 100 according to the embodiment.

The reflector 140 disposed on the outer circumference of the light emitting module 130 will be described below in more detail.

<Reflector 140>

Figure 2:
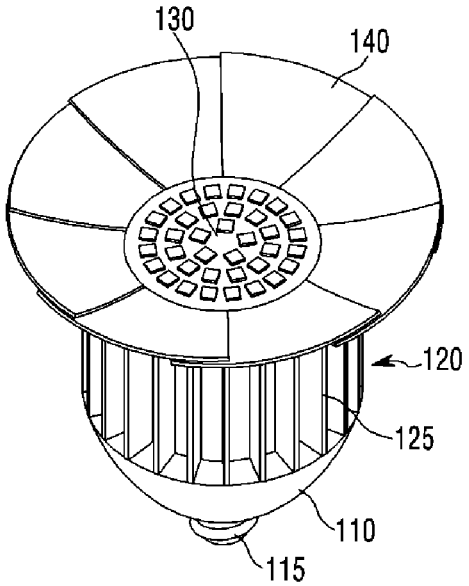
FIG. 2 is a perspective view of a reflector shown in FIG. 1 which is completely unfolded.

FIG. 2 is a perspective view of a reflector shown in FIG. 1 which is completely unfolded.

Referring to FIGS. 1 and 2, the reflector 140 may be disposed on the outer circumference of the light emitting module 130 and surround the light emitting module 130.

The reflector 140 may include a plurality of reflection plates 140*a*. One end of the reflection plate 140*a* may be coupled to the bottom surface of the body 120.

When it is assumed that a portion of the reflection plate 140*a*, which is coupled to the bottom surface of the body 120, is designated as one end and the other portion of the reflection plate 140*a*, which is opposite to the portion and farther from the body 120, is designated as the other end, the width of the reflection plate 140*a* may become greater toward the other end from the one end.

The reflector 140 is unfolded, which means that each of the reflection plates 140*a* moves toward the body 120 as shown in FIG. 2, so that the other end of the reflection plate 140*a* becomes closer to the bottom surface of the body 120. The reflector 140 is folded, which means that each of the reflection plates 140*a* moves perpendicular to the body 120, so that the other end of the reflection plate 140*a* becomes farther from the bottom surface of the body 120.

The reflector 140 may be folded, as shown in FIG. 1, with the increase of the overlapped portion between the reflection plates 140*a*. Also, as shown in FIG. 2, the reflector 140 may be unfolded with the decrease of the overlapped portion between the reflection plates 140*a*.

Figure 3:
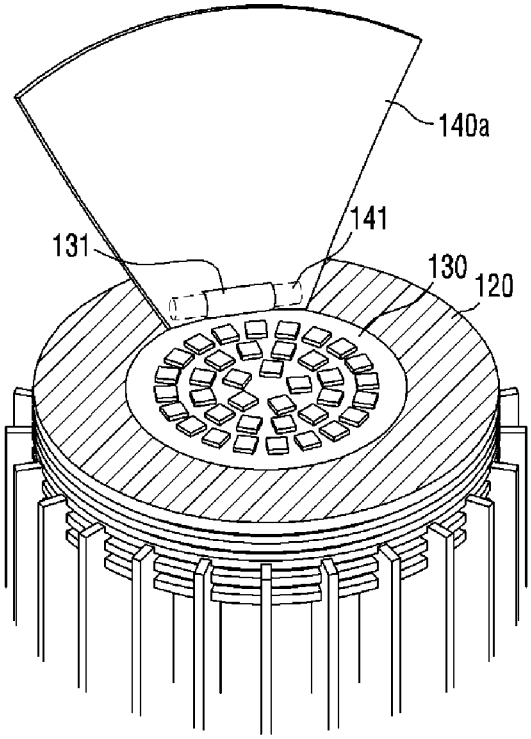
FIG. 3 is a view for describing how reflection plates are coupled to a body respectively.

The reflector 140 may be coupled to the bottom surface of the body 120 such that an inclination of the reflector 140 with respect to the bottom surface of the body 120 is variable. Specifically, the reflection plate 140*a* constituting the reflector 140 may be coupled to the bottom surface of the body 120 in such a manner as to be movable with respect to one end of the reflection plate 140*a*. FIG. 3 is a view for describing how reflection plates 140*a* are coupled to the body 120 respectively.

Referring to FIG. 3, the light emitting module 130 may include a hinge 131 in order that the reflection plate 140*a* is movably coupled to the bottom surface of the body 120. The hinge 131 is inserted into a cavity of the reflection plate 140*a*, and a pin 141 passing through the hinge 131 is fixed to an inner cavity of the reflection plate 140*a*. As a result, the reflection plate 140*a* can be movably coupled to the body 120.

The hinge 131 may be connected to the outer circumference of the light emitting module 130 or may be also disposed on the bottom surface of the body 120, on which the light emitting module 130 is disposed.

In FIG. 3, only one reflection plate 140*a* is shown in order to describe how the reflector 140 is coupled to the body 120. The rest of reflection plate as well as the shown reflection plate 140*a* may be coupled to the body 120 in the same manner. Accordingly, the reflector 140 may be hereby coupled to the body 120 in such a manner as to be folded or unfolded.

Referring to FIGS. 1 to 3, the couple strength of the hinge 131 and the reflection plate 140*a* may be variously determined depending on the implementation example of the lighting device 100 according to the embodiment.

When the lighting device 100 according to the embodiment is installed to emit light downwardly under the condition that the hinge 131 and the reflection plate 140*a* are loosely coupled to each other, the reflection plate 140*a* may be automatically folded by gravity. In this case, since the cap 150, which has an inner surface contacting with the reflector 140, and the cover 160, which surrounds the cap 150, are disposed under the reflector 140, the cover 160 and the cap 150 move up and down and limit the height of the unfolded reflector 140, so that it is possible to control the unfolding of the reflector 140. When the hinge 131 and the reflection plate 140*a* are tightly coupled to each other, the reflection plate 140*a* is fixed to a position set by a user and the user is able to adjust the angle of the reflection plate 140*a* in accordance with the user's favorite lighting effect.

The reflector 140 may be formed of a metallic material or a resin material which has high reflection efficiency. The resin material may include any one of PET, PC and PVC resin. The metallic material may include at least one of Ag, an alloy including Ag, Al, an alloy including Al. The curved surface of the reflector 140 may be coated with Ag, Al, white photo solder resist (PSR) ink, a diffusion sheet and the like. An oxide film may be formed on the curved surface of the reflector 140 by an anodizing process. However, there is no limit to the material and color of the reflector 140. The material and color of the reflector 140 may be variously determined depending on lighting implemented by the lighting device 100 according to the embodiment.

<Cap 150 and Cover 160>

Referring back to FIG. 1, the cap 150 is disposed under the reflector 140. The cover 160 surrounds an outer portion of the cap 150 and is coupled to the body 120.

The inner surface of the cap 150 may contact with the reflector 140. The cover 160 surrounds an outer portion of the cap 150 and is coupled to the body 120, and is able to perform a function to fix the positions of the cap 150 and the reflector 140.

The cap 150 is able to function as an optical member such as a lens. The cap 150 may be formed of glass, polymethylmethacrylate (PMMA), polycarbonate (PC) and the like. According to the design of the lighting device 10 based on the embodiment, the cap 150 may be formed to have a fluorescent material. Also, a photo luminescent film (PLF) including the fluorescent material may be attached to the light incident surface or light emitting surface of the cap 150. The fluorescent material may change the wavelength of light emitted from the light emitting module 130.

The cap 150 may be a lens having various shapes. For example, a light emitting portion of the cap 150 may have one of shapes of a parabolic lens shape, Fresnel lens shape, a convex lens shape or a concave lens shape.

The cover 160 has a central opening 161. The cap 150 is seated and fixed to the opening 161 of the cover 160. Although the cover 160 of FIG. 1 is rotatably coupled to the body 120 through the screw groove, a method by which the cover 160 is coupled to the body 120 is not limited to this. So long as the cover 160 is movable up and down, the body 120 and the cover 160 may be also coupled to each other in a different method.

Figure 4:
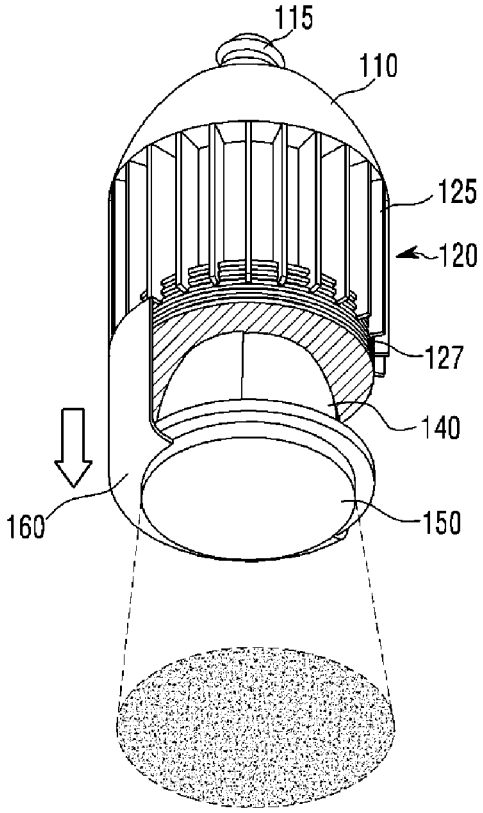
FIGS. 4 to 5 are views for describing an example of use of the lighting device shown in FIG. 1.
Figure 5:
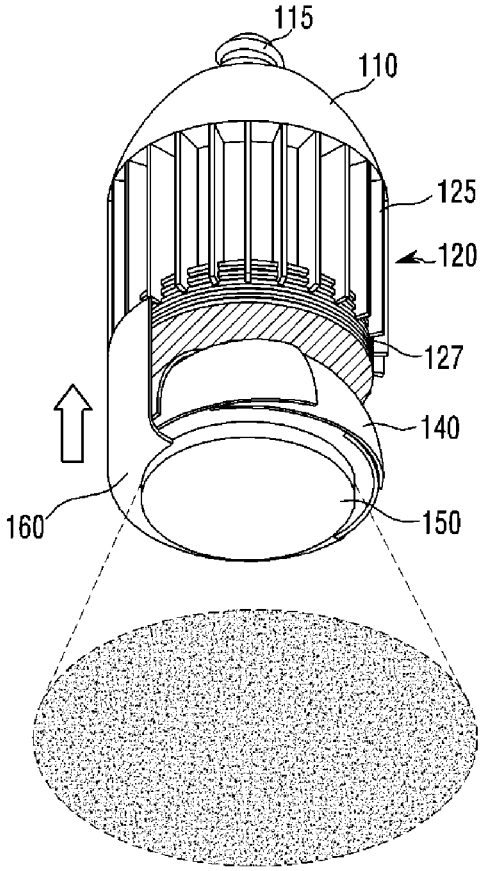

FIGS. 4 to 5 are views for describing an example of use of the lighting device shown in FIG. 1.

FIG. 4 shows that when the cover 160 moves down, a wide space is created between the bottom surface of the body 120 and the cap 150. In this case, the reflector 140 is folded and the lighting device 100 according to the embodiment has a small light distribution angle and a small light distribution range. FIG. 5 shows that when the cover 160 moves up, a small space is created between the bottom surface of the body 120 and the cap 150. In this case, the reflector 140 is widely unfolded and the lighting device 100 according to the embodiment has a large light distribution angle and a large light distribution range.

In FIGS. 4 to 5, the cover 160 is able to move up and down along the body 120 by a rotary motion. The cap 150 is also able to move up and down together with the cover 160. How much the reflector 140 is unfolded and folded can be controlled by the moving of the cap 150. Accordingly, since the inclination of the reflector 140 is changed by the rotary motion of the cover 160 or by the position of the cover 160 coupled to the body 120, the lighting device 100 according to the embodiment is able to implement various light distribution angles and light distribution ranges.

As such, the lighting device 100 according to the embodiment is able to provide various light distribution angles and light distribution ranges according to user's needs. Therefore, the user is able to obtain various lighting effects by installing one lighting device.

Figure 6:
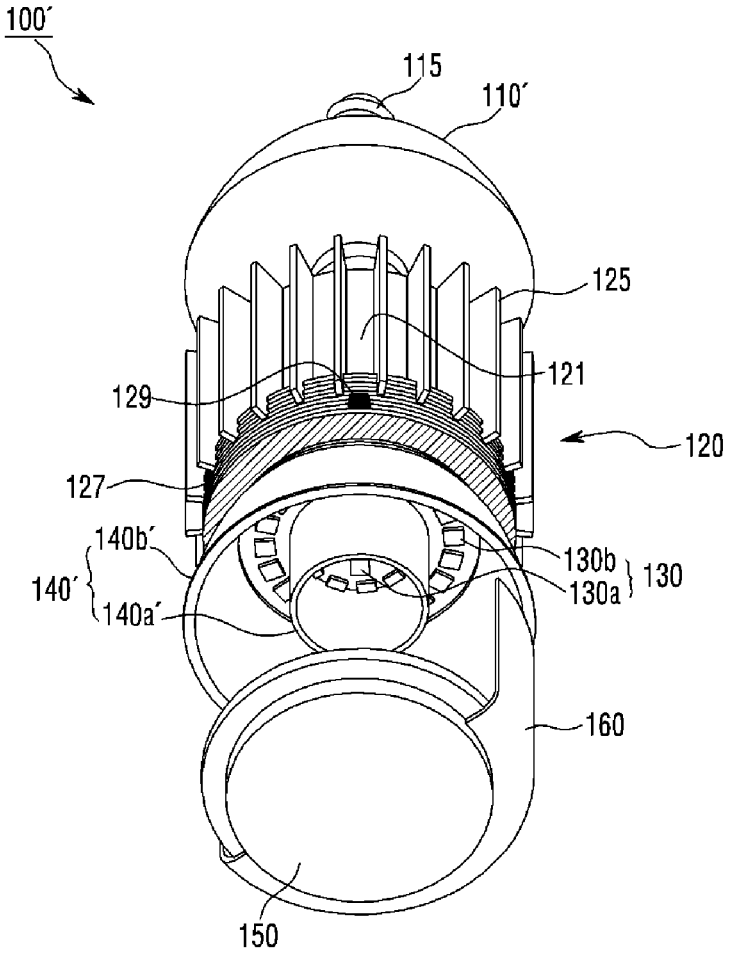
FIG. 6 is an exploded perspective view of a lighting device according to another embodiment.

FIG. 6 is an exploded perspective view of a lighting device according to another embodiment.

A lighting device 100' according to another embodiment may include a driving unit 110', a body 120 disposed under the driving unit 110', a light emitting module 130 disposed on the bottom surface of the body 120, a reflector 140' which surrounds the light emitting module 130 and is disposed on the bottom surface of the body 120, a cap 150 disposed under the reflector 140', and a cover 160 which surrounds an outer portion of the cap 150 and is coupled to the body 120.

Since the body 120, the light emitting module 130, the cap 150 and the cover 160 of the lighting device 100' according to another embodiment are the same as the body 120, the light emitting module 130, the cap 150 and the cover 160 of the lighting device 100 according to the embodiment shown in FIGS. 1 to 5, descriptions thereof are replaced by the foregoing description.

Hereafter, the lighting device 100' according to another embodiment will be described focusing on the driving unit 110' and the reflector 140'.

The driving unit 110' according to another embodiment has the shape and function of the driving unit 100 shown in FIG. 1. In addition to this, the driving unit 110' is able to control a first light emitting module 130*a* and a second light emitting module 130*b*. This will be described with reference to FIG. 7.

Figure 7:
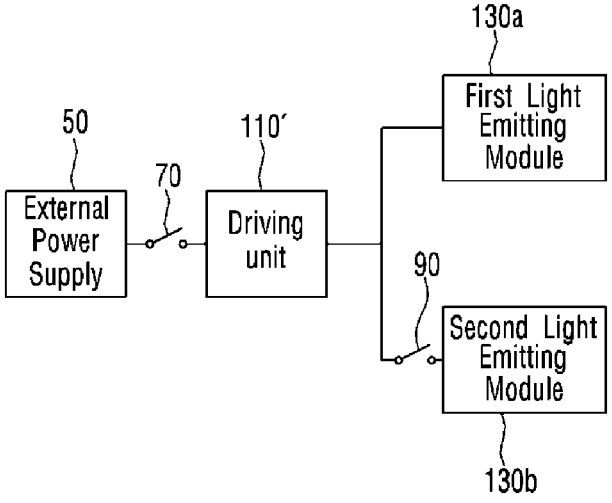
FIG. 7 is a block diagram showing electrical connections of the lighting device shown in FIG. 6.

FIG. 7 is a block diagram showing electrical connections of the lighting device shown in FIG. 6.

Referring to FIG. 7, the driving unit 100' receives electric power from an external power supply 50 and supplies the electric power to the first and the second light emitting modules 130*a* and 130*b*. A power switch 70 is disposed between the external power supply 50 and the driving unit 110'. In a space in which the lighting device 100' according to another embodiment is installed, the external power supply 50 may be disposed on a wall and the like which allows a user to easily approach.

The driving unit 100' is electrically connected to the first light emitting module 130*a* and the second light emitting module 130*b*. A drive switch 90 may be disposed between the driving unit 100' and the second light emitting module 130*b*. Here, though the drive switch 90 is connected to only the second light emitting module 130*b*, the drive switch 90 may be disposed to be connected to the first light emitting module 130*a*.

The drive switch 90 may be connected to an external switch 129 disposed in the body 120. Specifically, the drive switch 90 may be connected to the external switch 129 disposed on the outer surface of the body 120. The external switch 129 is connected to the drive switch 90 connected to the second light emitting module 130*b*, and then the drive switch 90 is closed by pressing the external switch 129. The external switch 129 may be pressed by a user or by the cover 160 coupled to the body 120. Specifically, the cover 160 moves up by rotating along the coupling groove 127 of the body 120, and then is coupled to the external switch 129. As the cover 160 presses and covers the external switch 129 by moving up along the body 120, the second light emitting module 130*b* may be driven. The external switch 129 may have a trapezoidal shape or a streamlined shape so as to allow the cover 160 to easily press and pass the external switch 129.

The electricity supply to the first and the second light emitting modules 130*a* and 130*b* will be described. When the user closes the power switch 70, electric power is supplied to the lighting device 100' from the external power supply 50. Then, the first light emitting module 130*a* is driven. If the drive switch 90 is closed by the operation of the external switch 129, the second light emitting module 130*b* is also driven. As such, the first and the second light emitting modules 130*a* and 130*b* can be selectively controlled. When a switch is disposed in the first light emitting module 130*a*, the first and the second light emitting modules 130*a* and 130*b* can be controlled completely independently of each other.

Unlike the reflector 140 shown in FIG. 1, the reflector 140' has a fixed shape. Specifically, the shape of the reflector 140' is not changed by the moving of the cover 160.

The reflector 140' may include a first reflector 140*a*' and a second reflector 140*b*'. The second reflector 140*b*' is disposed to surround the first reflector 140*a'*.

The first reflector 140*a*' surrounds the first light emitting module 130*a*. The second reflector 140*b*' surrounds the second light emitting module 130*b*. The first and the second reflectors 140*a*' and 140*b*' reflect the light generated from the first and the second light emitting modules 130*a* and 130*b*, and are able to adjust the distribution angle and distribution range of light emitted from the lighting device 100' according to another embodiment.

Here, the first light emitting module 130*a* is disposed in a first area of the body 120. The second light emitting module 130*b* is disposed in a second area of the body 120. Specifically, the first light emitting module 130*a* may be disposed in the central portion of the bottom surface of the body 120. The second light emitting module 130*b* may be disposed on the outer circumference of the bottom surface of the body 120. The second light emitting module 130*b* may be disposed to surround the first light emitting module 130*a*.

An angle formed between the first and the second light emitting modules 130*a* and 130*b* on the basis of the bottom surface of the body 120 may be selected according to the type of the embodiment and is not limited to what is shown in FIG. 6.

Figure 8:
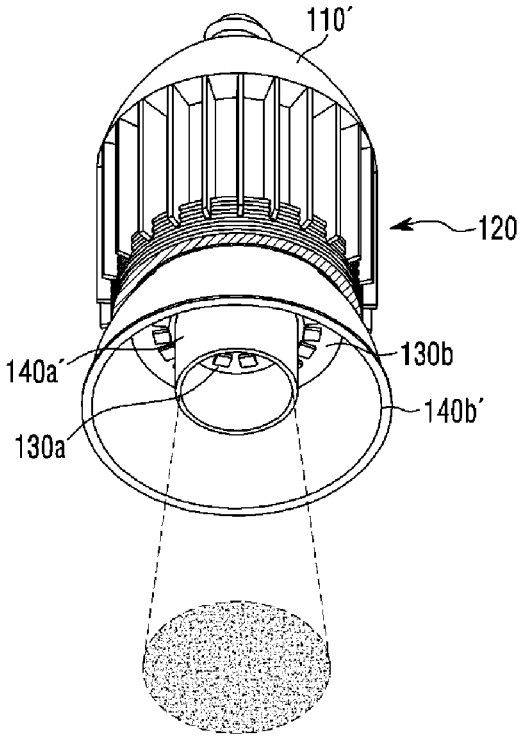
FIGS. 8 to 9 are views for describing an example of use of the lighting device shown in FIG. 6.
Figure 9:
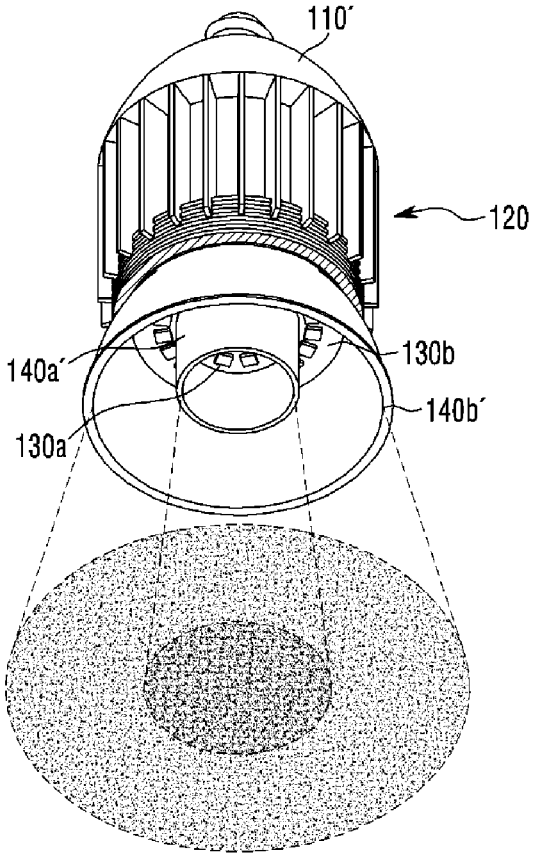

FIGS. 8 to 9 are views for describing an example of use of the lighting device shown in FIG. 6.

FIG. 8 shows that only the first light emitting module 130*a* is driven. FIG. 9 shows that both of the first and the second light emitting modules 130*a* and 130*b* are driven.

Referring to FIGS. 8 and 9, in the lighting device 100' according to another embodiment, the light distribution angle and light distribution range where only the first light emitting module 130*a* is driven are larger than those where both of the first and the second light emitting modules 130*a* and 130*b* are driven. Here, only the second light emitting module 130*b* can be also driven when the drive switch is connected to the first light emitting module 130*a*.

As such, a plurality of the light emitting modules are selectively controlled, so that it is possible to provide various light distribution angles and light distribution ranges according to user's needs by one lighting device.

Figure 10:
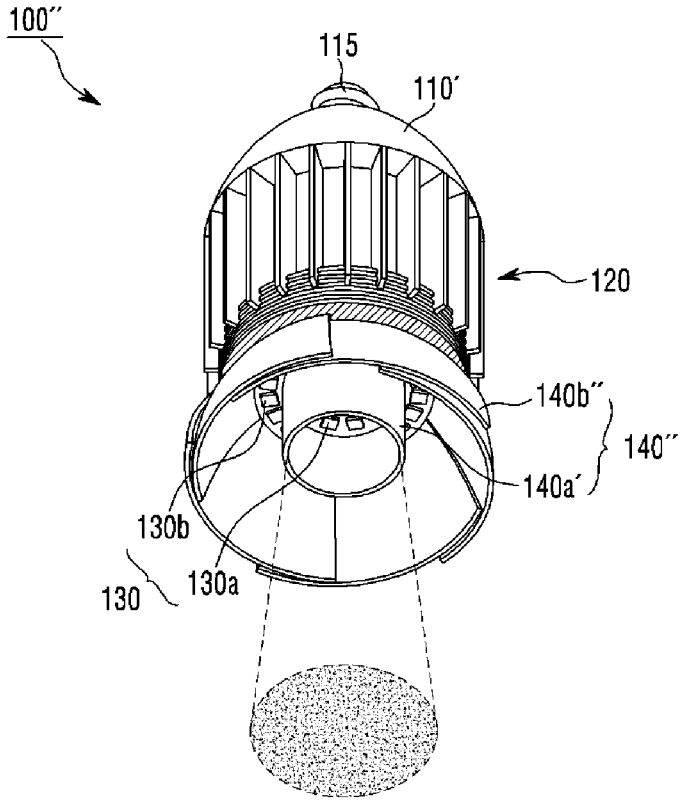
FIG. 10 is a perspective view of a lighting device according to further another embodiment.

FIG. 10 is a perspective view of a lighting device according to further another embodiment.

Referring to FIG. 10, a lighting device 100" according to further another embodiment is similar to the lighting device 100' according to another embodiment shown in FIG. 6. A reflector 140" of the lighting device 100" according to further another embodiment is different from the reflector 140' of the lighting device 100' according to another embodiment shown in FIG. 6. Particularly, a second reflector 140*b*" of the lighting device 100" according to further another embodiment is different from the second reflector 140*b*' of the lighting device 100' according to another embodiment shown in FIG. 6.

The second reflector 140*b*" may be, like the reflector 140 shown in FIG. 1, constituted by a plurality of reflection plates. The second reflector 140*b*" constituted by a plurality of the reflection plates may be folded or unfolded by the rotary coupling of the cover (not shown). That is, the inclination of the second reflector 140*b*" may be changed by the moving of the cover (not shown).

Although the reflector constituted by a plurality of the reflection plates is shown as the second reflector 140*b*" in FIG. 10, the first reflector 140*a*' may be also constituted by a plurality of the reflection plates.

As shown in FIG. 10, at least one of a plurality of the reflectors may be constituted by a plurality of the reflection plates. Accordingly, it is possible to implement more various light distribution angles and light distribution ranges through a combination of which is driven among a plurality of the light emitting modules and variable angle of the reflector.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting device comprising:

a driving unit;

a body which is disposed under the driving unit and includes one side including a first area and a second area surrounding the first area;

a first light emitting module which receives electric power from the driving unit and is disposed in the first area of the body;

a second light emitting module which receives electric power from the driving unit and is disposed in the second area of the body;

a first reflector which is disposed on the one side of the body and surrounds the first light emitting module;

a second reflector which is disposed on the one side of the body and surrounds the second light emitting module, wherein the driving unit controls the first light emitting module and the second light emitting module independently of each other; and a cover coupled to the body in such a manner as to be movable up and down with respect to the body, and wherein the driving of the first and the second light emitting modules is controlled by the moving of the cover.

2. The lighting device of claim 1, wherein an inclination of the first reflector based on the one side of the body is different from an inclination of the second reflector based on the one side of the body.

3. The lighting device of claim 1, wherein the first light emitting module is disposed in the central portion of the one side of the body, and wherein the second light emitting module is disposed on the outer circumference of the one side of the body.

4. The lighting device of claim 1, wherein the cover is rotatably coupled to the body and moves up and down according to the rotary motion.

5. The lighting device of claim 1, further comprising:

the cover disposed on the first and the second light emitting modules and the first and the second reflectors, and the cover is connected to the body and has an opening; and a lens disposed in the opening of the cover.

6. The lighting device of claim 5, wherein the body comprises a switch determining the driving of at least one of the first and the second light emitting modules, and wherein the switch is disposed on a coupling portion between the cover and the body, and is operated by contact with the cover.

* * * * *